US009445967B2

(12) United States Patent
Woerlee et al.

(10) Patent No.: US 9,445,967 B2
(45) Date of Patent: Sep. 20, 2016

(54) AUTOMATED CPR DEVICE

(75) Inventors: Pierre Hermanus Woerlee, Eindhoven (NL); Igor Wilhelmus Franciscus Paulussen, Eindhoven (NL); Frank Titus Marie Jaartsveld, Eindhoven (NL); Shervin Ayati, Carlisle, MA (US); Thomas Jan De Hoog, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 702 days.

(21) Appl. No.: 13/125,813

(22) PCT Filed: Oct. 23, 2009

(86) PCT No.: PCT/IB2009/054692

§ 371 (c)(1),
(2), (4) Date: Aug. 9, 2013

(87) PCT Pub. No.: WO2010/049861

PCT Pub. Date: May 6, 2010

(65) Prior Publication Data

US 2014/0005578 A1 Jan. 2, 2014

(30) Foreign Application Priority Data

Oct. 29, 2008 (EP) ..... 08167817

(51) Int. Cl.
*A61H 31/00* (2006.01)

(52) U.S. Cl.
CPC ..... *A61H 31/006* (2013.01); *A61H 31/004* (2013.01)

(58) Field of Classification Search
CPC .. A61H 31/00; A61H 31/004; A61H 31/006; A61H 2031/002; A61H 2201/12; A61H 2201/1207; A61H 2201/1215; A61H 2201/1481; A61H 2201/149; A61H 2203/00; A61H 2203/0443; A61H 2203/0456; A61H 2205/084
USPC ..... 601/41–44
See application file for complete search history.

(56) References Cited

U.S. PATENT DOCUMENTS

| | | | | |
|---|---|---|---|---|
| 3,489,140 | A * | 1/1970 | Mullikin | A61H 31/006 601/41 |
| 5,066,106 | A | 11/1991 | Sakamoto et al. | |
| 5,171,267 | A | 12/1992 | Ratner et al. | |
| 6,174,295 | B1 * | 1/2001 | Cantrell | A61H 31/00 601/41 |
| 2002/0026131 | A1 * | 2/2002 | Halperin | A61H 9/0078 601/41 |
| 2004/0220501 | A1 | 11/2004 | Kelly et al. | |
| 2004/0230140 | A1 | 11/2004 | Steen | |
| 2004/0262683 | A1 | 12/2004 | Bohr et al. | |
| 2008/0092677 | A1 * | 4/2008 | Tjolsen | A61H 31/006 601/43 |
| 2008/0119766 | A1 | 5/2008 | Havardsholm et al. | |

FOREIGN PATENT DOCUMENTS

| | | | |
|---|---|---|---|
| EP | 1915980 | A2 | 4/2008 |
| WO | 2007011798 | A2 | 1/2007 |

* cited by examiner

*Primary Examiner* — Quang D Thanh

(57) ABSTRACT

This invention relates to an automated cardiopulmonary resuscitation device for cyclically compressing a patient's chest. The CPR device comprises a front structure with a first and a second movable unit arranged to move back and forth along said front structure; a back support for positioning behind the patient's back arranged to keep the front structure in a fixed position relative to the patient's back; a chest pad; two arms each rotatably coupled to the chest pad with one end and each being rotatably coupled to a respective one of the first and the second movable units; and a motor arranged for, when in operation, driving the first and the second movable units back and forth such that the chest pad cyclically compresses the patient's chest.

8 Claims, 5 Drawing Sheets

AUTOMATED CPR DEVICE

FIELD OF THE INVENTION

The present invention relates to an automated CPR device for cyclically compressing a patient's chest.

BACKGROUND OF THE INVENTION

Cardiopulmonary resuscitation (CPR) is a well known and valuable method of first aid. CPR is used to resuscitate people who have suffered from cardiac arrest after heart attack, electric shock, chest injury and many other causes. During cardiac arrest, the heart stops pumping blood, and a person suffering cardiac arrest will soon suffer brain damage from lack of blood supply to the brain. Thus, CPR requires repetitive chest compression to squeeze the heart and the thoracic cavity to pump blood through the body. It has been widely noted that CPR and chest compression can save cardiac arrest victims, especially when applied immediately after cardiac arrest.

Chest compression requires that the person providing chest compression repetitively push down on the sternum of the victim at 80-100 compressions per minute. However, when chest compression is required for long periods of time, it is difficult if not impossible to maintain adequate compression of the heart and rib cage. Even experienced paramedics cannot maintain adequate chest compression for more than a few minutes.

Since CPR quality is of great importance for the patient's survival, there is a need to have a mechanical, automated CPR device to replace less reliable and long duration manual chest compressions. These devices compress and decompress a subject's chest in a cyclical fashion. One such automated CPR device is described in EP1915980. A transmission device transforms an alternate rotational movement of an alternately rotating element into a linear reciprocating movement in a resuscitation device. The alternate rotating element inputs rotation energy from e.g. an electric motor, or a hydraulic system. A major drawback of EP1915980 is that the motor is not running near its most optimal working region. This is not the most optimal solution for an automated CPR device where the power consumption is not optimal due to the mismatch of motor and human thorax characteristics. Because the automated CPR device needs to be portable, weight and energy efficiency are important factors. The following has to be considered.

To apply automated CPR, the thorax needs to be pressed with a certain desired trapezium like displacement profile. An example of such a profile is depicted in FIG. 1. This is the desired compression waveform for a frequency of 90 compressions per minute. The required force needed to obtain the compression waveform in FIG. 1 is shown in FIG. 2.

The force-compression relation of the human thorax is shown in FIG. 3. For the first three cm of compression, the chest is rather compliant and a relatively small force is sufficient. For larger compression depths the chest becomes very stiff and the required force increases strongly.

An important aspect of power consumption is the repetitive acceleration and de-acceleration of the motor to obtain the required compression profile shown in FIG. 1. Typically the motor must change rpm from almost zero to approximately 5000 rpm, de-accelerate to 0 rpm, and accelerate in the reverse direction to again 5000 rpm and brake to zero rpm again. A large angular acceleration requires a large torque, and hence a large current, and as small as possible moment of inertia. Minimizing the moment of inertia, as well as the required angular velocity and acceleration for a specific compression profile, pays off in reduced power consumption.

First consider a system with a DC brushless motor driven by a current controlled servo amplifier with given voltage compliance. The highest rpm and motor torque are determined by the maximum voltage and current, respectively. The transmission ratio T between the motor angle or number of motor revolutions and the chest pad position X, is assumed constant. When T is small the motor will run at very high rpm n and has a small torque. Consequently, fast acceleration of the chest pad is possible but large moments and forces cannot be exerted. This is acceptable for a small compression depth, but at larger compression depth the reaction force and the reaction moment will be very large. Consequently, the motor cannot efficiently deliver this high torque and the desired compression depth is not achieved while very large current is consumed; the motor operation is hence inefficient.

For a large T the motor will run at low rpm n. Hence acceleration of the chest pad is low, and a high moment and high force can be delivered. For high acceleration a large motor voltage is required and the motor is not in its most efficient region. For optimum efficiency it has been shown that the motor should operate around 80-85% of its maximum angular velocity. A compression pulse with short rise time of approximately 100 ms is however required for high quality CPR; hence the large T is not acceptable.

From the above it is clear that the correct choice of T is not straightforward. The trade-off between acceleration and required force is required; as a consequence a fixed transmission is not optimal for the highly non-linear human mechanical load. Moreover, the optimum T may vary significantly from person to person as there is a high variability in thorax properties from person to person.

SUMMARY OF THE INVENTION

The object of the present invention is to provide an automated CPR device which is performing in a more optimal working region, i.e. it is more energy-efficient.

According to one aspect the present invention relates to an automated CPR device for cyclically compressing a patient's chest comprising:

- a front structure with a first and a second movable unit arranged to move back and forth along said front structure; a back support for positioning behind the patient's back and is arranged to keep the front structure in a fixed position relative to the patient's back;
- a chest pad;
- two arms each rotatably coupled to the chest pad with one end and each being rotatably coupled to a respective one of the first and the second movable units; and
- driving means arranged for, when in operation, driving the first and the second movable units back and forth such that the chest pad cyclically compresses the patient's chest.

There are several advantages with the CPR device according to the present invention. Starting from the upper position of the chest pad, the vertical displacement of the chest pad is larger than the horizontal displacement of the movable units. This is favorable for the motor acceleration, since a relatively small change in motor angle is required to obtain a relatively large movement of the chest pad. The trade-off is that the force in the vertical direction is correspondingly reduced. With increasing vertical displacement of the chest pad, the angle between the two arms decreases and as a result the ratio between vertical and horizontal displacement decreases and the ratio between forces in the vertical and horizontal direction increases. The transmission has thus a variable relation between displacement and force as a function of the compression depth. At a small compression depth, a small force and high acceleration is achieved, and at a larger compression depth, a higher delivered force and a low acceleration is achieved, as desired. The transmission ratio is thus small in the initial phase of the compression and it increases with the compression depth. Because the transmission ratio varies as a function of the compression depth in a continuous way, it may thus be described as continuously variable transmission. Such a transmission is a better match for the highly non-linear human mechanical load and it facilitates treatment of persons having varying thorax properties. In this manner the CPR device is performing in a more optimal working region, i.e. it is more energy-efficient and consumes less power. Hence, a smaller battery is required, thus saving in on weight and size of the CPR device according to the invention. This V-shaped transmission configuration therefore fulfills the needs for transmission of an automated CPR device.

In a preferred embodiment, the front structure of the automated CPR device comprises a threaded, driven spindle, and said first and second movable units are arranged to engage with the threaded spindle so as to move back and forth along said front structure. Using a spindle with threads, or a screw-like configuration, allows for a speedy and precise control of the movable units and hence of the chest pad against the patient's chest. In this manner, a rotational motion of the spindle, driven by e.g. a rotational motor, is converted into a translational, or linear motion of the chest pad. This embodiment allows the movable units to engage with multiple spindles, if desired.

In another preferred embodiment the spindle comprises two parts with an opposite lead direction so as to move said first and second movable units in opposite directions. Advantageously, one spindle may be used having two parts with opposite threads, such that a driven rotation of the spindle in one direction move the movable units towards each other, and a driven rotation in the opposite direction move them away from each other. Correspondingly, the chest pad compresses and decompresses the patient's chest. Using only one spindle saves weight and money, allows a simple construction with one motor driving one spindle, and it facilitates a synchronized movement of the two arms, and thus a symmetric, desired movement of the chest pad against the patient's chest.

In another preferred embodiment the front structure of the automated CPR device comprises a belt system comprising a belt and a pulley, the belt being arranged to be driven by and looped around the pulley, and said first and second movable units are coupled to said belt so as to move back and forth along said front structure. Advantageously, a belt-driven system is cheaper, has lower friction and produces less mechanical noise than the spindle-configuration. Lower friction leads to less heat production and less power consumption; hence, less battery capacity and a smaller driving means, or motor, are required. Furthermore, omitting the spindle and the threading-engaging movable units also leads to lower weight and a very compact building height having a lower centre of gravity.

In another preferred embodiment, the belt system comprises another pulley for the belt to be looped around, the belt system extending along the front structure, and said first and said second movable units are each arranged to be coupled on a respective, mutually exclusive side of the belt system so as to move in opposite directions in relation to each other. Advantageously, a driven rotation of the belt in one direction moves the movable units towards each other and a driven rotation in the opposite direction moves them away from each other. Correspondingly, the chest pad compresses and decompresses the patient's chest.

In other preferred embodiments, a chain and a chain-wheel are used instead of a belt and a pulley as described in the two previous embodiments. This has the advantage of being durable and rigid. It also prevents any slipping of the chain in relation to the chain-wheel, thus having a quick response-time and being accurate.

In another preferred embodiment, the front structure comprises rigid means for guiding said first and second movable units back and forth along said front structure. Due to the belt system having a somewhat more flexible structure than the spindle-configuration, it may be advantageous to use e.g. some kind of rails for guiding the movement of the movable units.

In another preferred embodiment, the driving means is selected from the group consisting of an electromagnetic, a pneumatic, or a hydraulic motor, which provides either a rotational force, or a linear force. The present invention advantageously makes use of the rotational or linear motion and converts it into a translational or linear motion, of the chest pad in the direction of the chest. One advantage of using an electromagnetic motor, and especially one that is servo controlled, is that an optimum force pulse is obtained for a desired compression waveform, i.e. the force is personalized for the specific patient and his body/thorax properties.

Another automated CPR device is the LUCAS machine described in US 2004/0230140. This device includes a pneumatically driven compressor unit which reciprocally drives a chest contact pad to mechanically compress/decompress the subject's chest. The subject is rested in a supine position during CPR administration. The compressor unit is mechanically supported vertically above the subject's chest so that the contact pad is in mechanical contact with the subject's chest about the sternum. In favor of the present invention it has been demonstrated to provide a better controlled compression depth, i.e. it provides a more personalized compression force, is more stable and safe due to having a lower weight and a lower centre of gravity, has a longer operating time due to being more energy-efficient, and produces less acoustic noise.

BRIEF DESCRIPTION OF THE DRAWINGS

Embodiments of the invention will be described, by way of example only, with reference to the drawings, in which.

DESCRIPTION OF EMBODIMENTS

Figure 1:
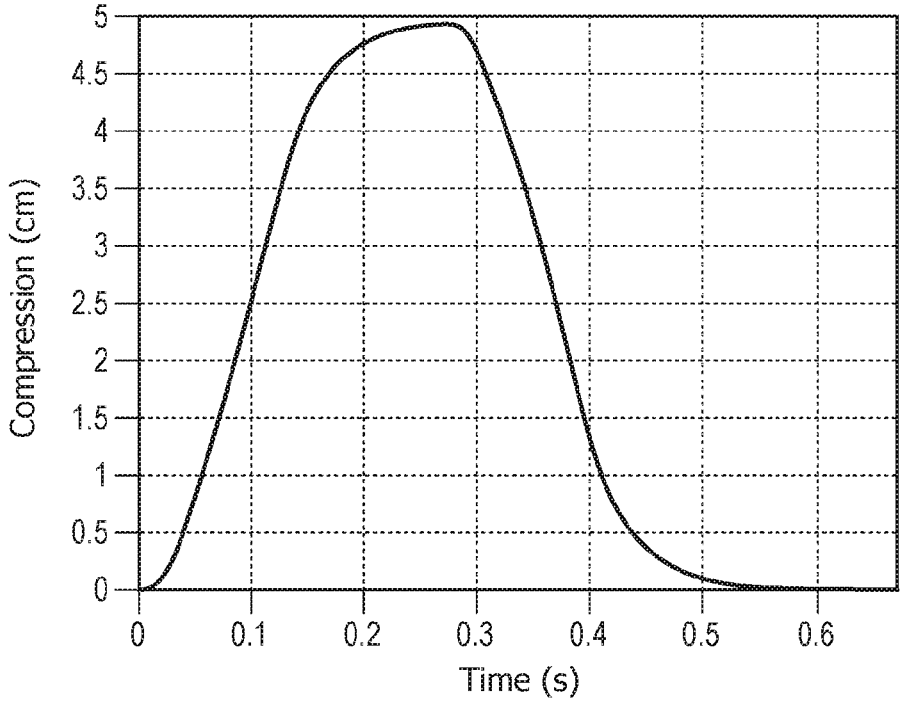
FIG. 1 shows a diagram of the desired compression waveform.
Figure 2:
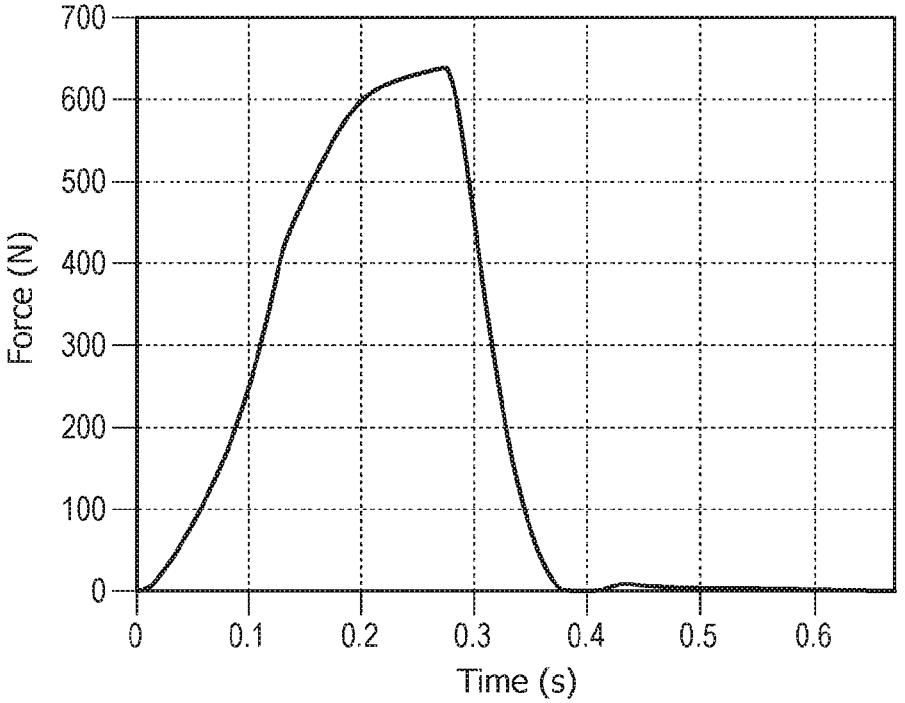
FIG. 2 shows a diagram of the required force to obtain the compression waveform in FIG. 1.
Figure 3:
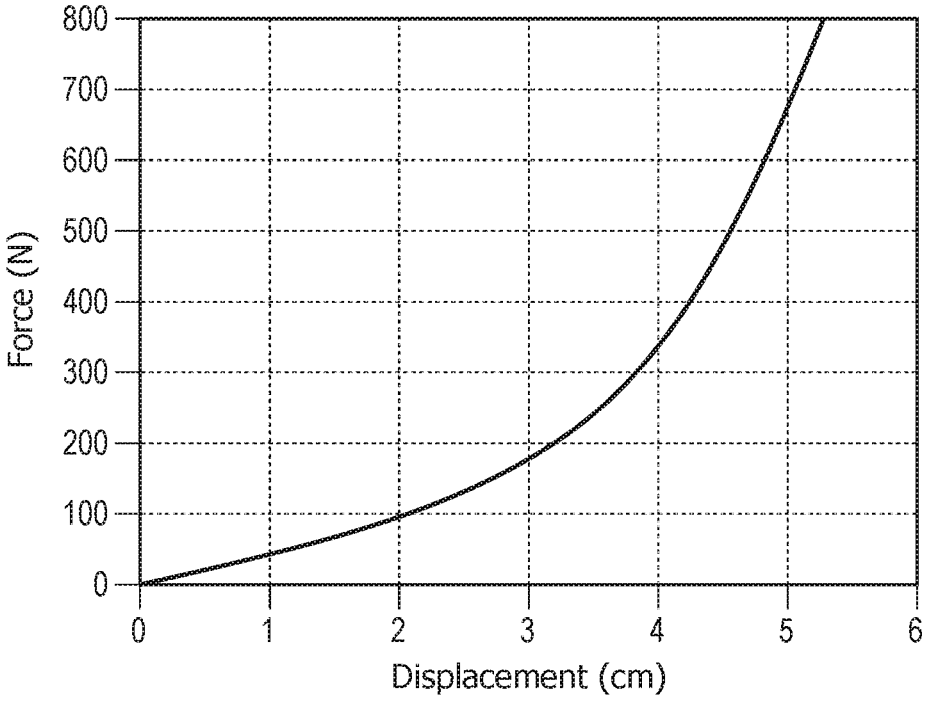
FIG. 3 shows a diagram of the elastic force versus compression depth for an average person.
Figure 4:
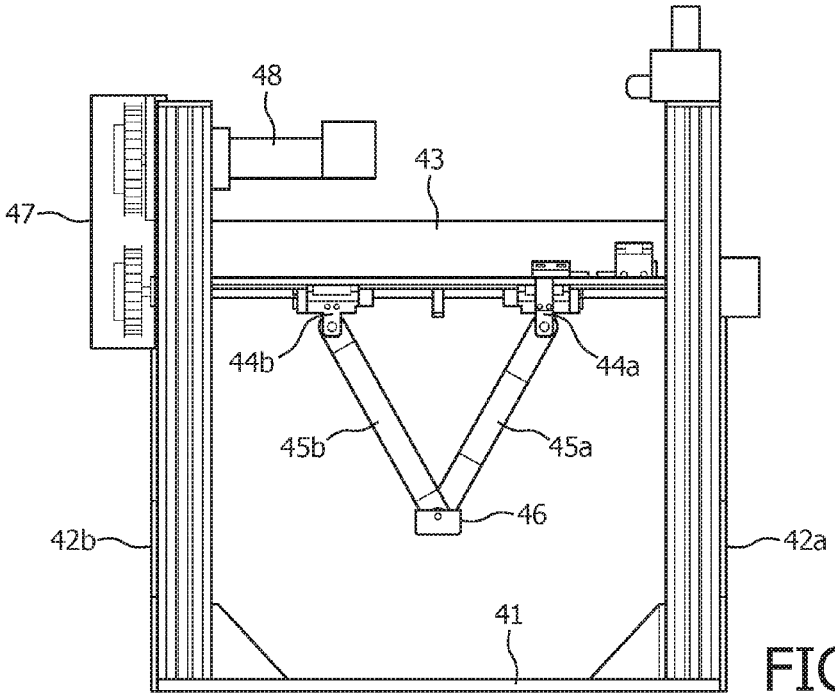
FIG. 4 shows a schematic front view of the automated CPR device according to an embodiment of the present invention.
Figure 5:
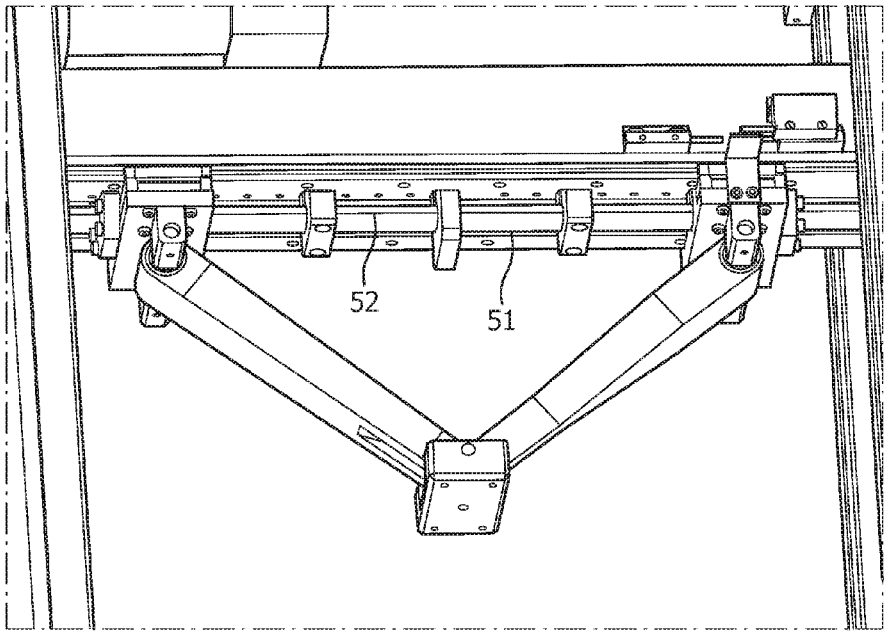
FIG. 5 shows a perspective front view of the automated CPR device according to an embodiment of the present invention.

FIG. 4 shows a schematic drawing of the automated CPR device for cyclically compressing a patient's chest. The CPR device comprises a back support 41 for positioning behind the patient's back. Two upstanding columns 42*a,b* are attached at their lower part to the back support 41. A front structure 43 is connected to the upstanding columns 42*a,b* at their upper part. The back support 41 is arranged to keep the front structure 43 in a fixed position, or in a relatively fixed position, relative to the patient's back. Without the back support 41, the whole CPR device would have a tendency to move away from the patient's chest when operating it. The front structure 43 comprises a first and a second movable unit 44*a,b* arranged to move back and forth along said front structure 43. The CPR device further comprises a chest pad 46 which is arranged to contact and compress/decompress the patient's chest. The chest pad 46 may comprise or may be arranged to distribute the force over the chest area, an adhesive layer may be applied on the chest pad 46 in order to attach better to the patient's chest. Two arms 45*a,b* are each rotatably coupled to the chest pad 46 with one end and each arm is rotatably coupled to a respective one of the first and the second movable units 44*a,b*. The two arms 45*a,b* may be rotatably, or pivotally, coupled to the chest pad 46 at either separate points of the chest pad 46, or preferably at a single, common point having a common rotational, or pivotal, axis. The CPR device further comprises driving means 47, 48 (and 51, 52 in FIG. 5) arranged for, when in operation, driving the first and the second movable units 44*a,b* back and forth such that the chest pad 46 cyclically compresses the patient's chest. The driving means comprises preferably an electromagnetic motor 48, or more specifically, a brush (less) DC motor which provides a rotational force, but pneumatic or hydraulic means could also be arranged to provide the required motion of the units 44*a,b*. The motor 48 is preferably servo controlled. A battery supplies the power to the motor 48. The motor 48 is arranged to rotate a gearwheel, a cogwheel, or a pulley 47, which in turn drives a spindle, or a shaft 51, 52. The two arms 45*a,b* may be connected via ball-screws having reduced friction to the spindle. Preferably, the spindle is split in two parts 51, 52 with opposite lead direction. When the motor 48 turns e.g. clock wise, the movable units 44*a,b* and the arms 45*a,b* move inward, and when the motor 48 turns counter clockwise, the movable units 44*a,b* and the arms 45*a,b* move outward.

Figure 6:
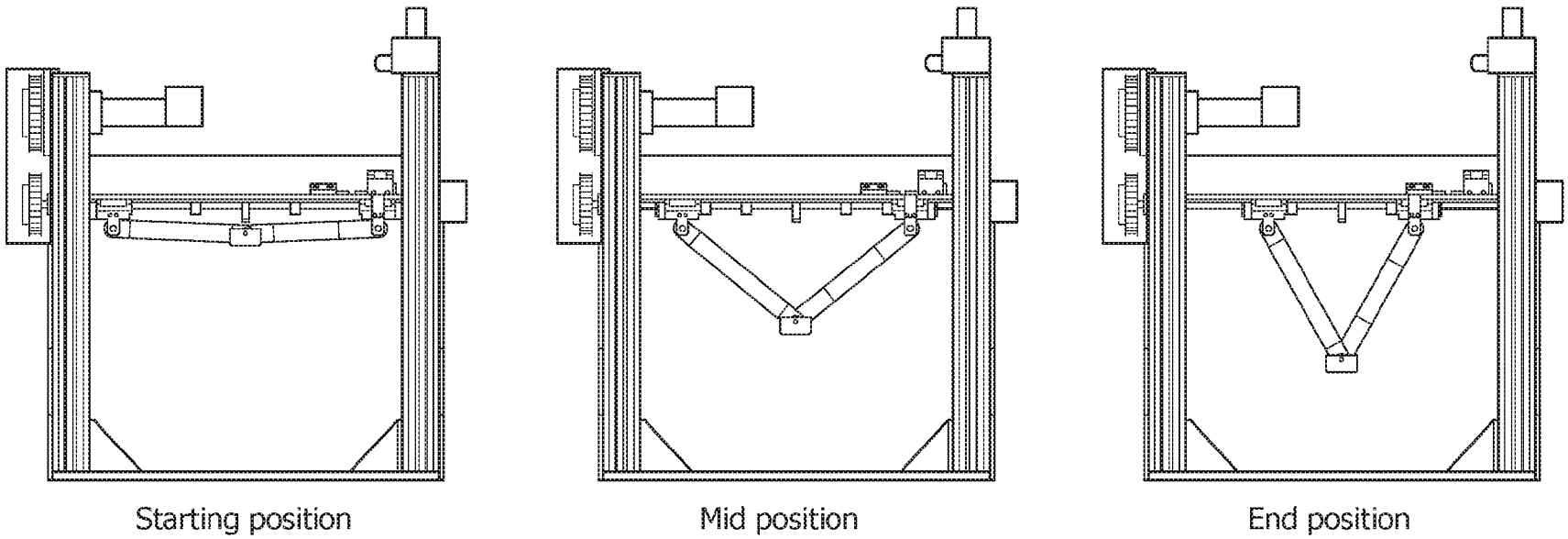
FIG. 6 shows schematic front views of three stages of the automated CPR device according to an embodiment of the present invention.

In FIG. 6 front views of three stages of the automated CPR device are shown. In the stand-by position, the first and the second movable units 44*a,b* are positioned at the outer parts of the front structure 43, and hence, the chest pad is in its top position. The patient may be placed with his back towards the back support 41 with his frontal part of the body facing the front structure 43. The motor 48 starts rotating the spindle 51, 52, the first and the second movable units 44*a,b* and the arms 45*a,b* are thus driven inwards and together, and consequently the chest pad 46 moves towards the patient until the pad contacts the chest, thus reaching the starting position. The angle between the two arms is around 140 degrees. The chest pad then moves between the start and end positions, respectively. The motor 48 then turns counter clock-wise, the whole movement reverses, and the starting position is once again reached. In this manner the chest pad 46 cyclically compresses the patient's chest. The rotation motion of the motor 48 is thus transformed into a translation motion of the chest pad 46.

Figure 7:
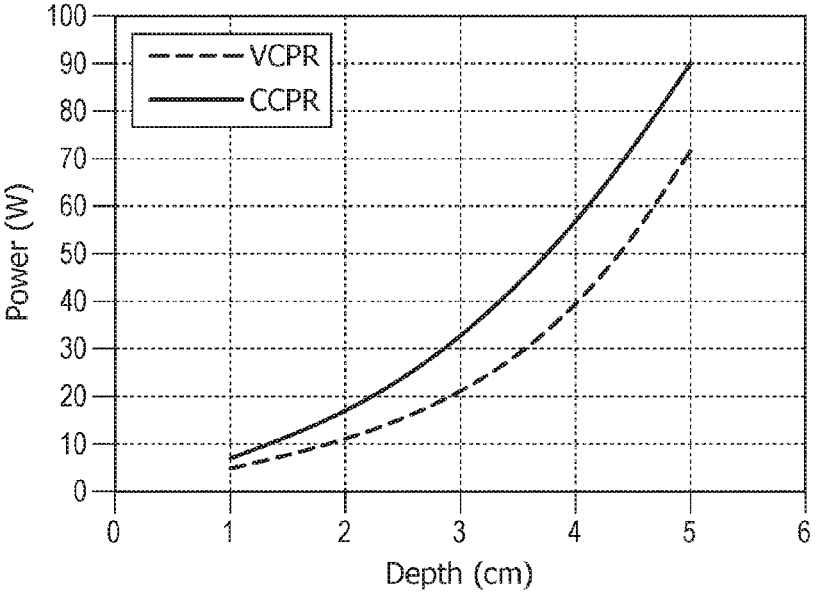
FIG. 7 shows a diagram of a simulated power consumption of a system with two different transmissions.

A typical required compression depth is between 4 and 6 centimeters and the required force can be as large as 800 N. Calculations show that translation of the rotary motion of the motor to a translational motion may deliver around 1000N. In FIG. 7, a simulated power consumption of a system with two different transmissions is shown, one with the V-arm transmission according to the present invention and one with a transmission with a constant optimum gear ratio of 1.67. The simulations have been calibrated on experimental data of a test system and they agree within 10% of the experimental values. For both cases the transmission parameters as well as the PID control were optimized for minimum power. Clearly the device with variable transmission according to the present invention has significantly reduced power consumption, some 30-40% lower power consumption for the compression depth 4-5 cm, all other factors being equal. Further advantages of the system are the symmetry of the CPR device which guarantees motion in the vertical direction only and which also distributes the forces along the V-arms.

Figure 8:
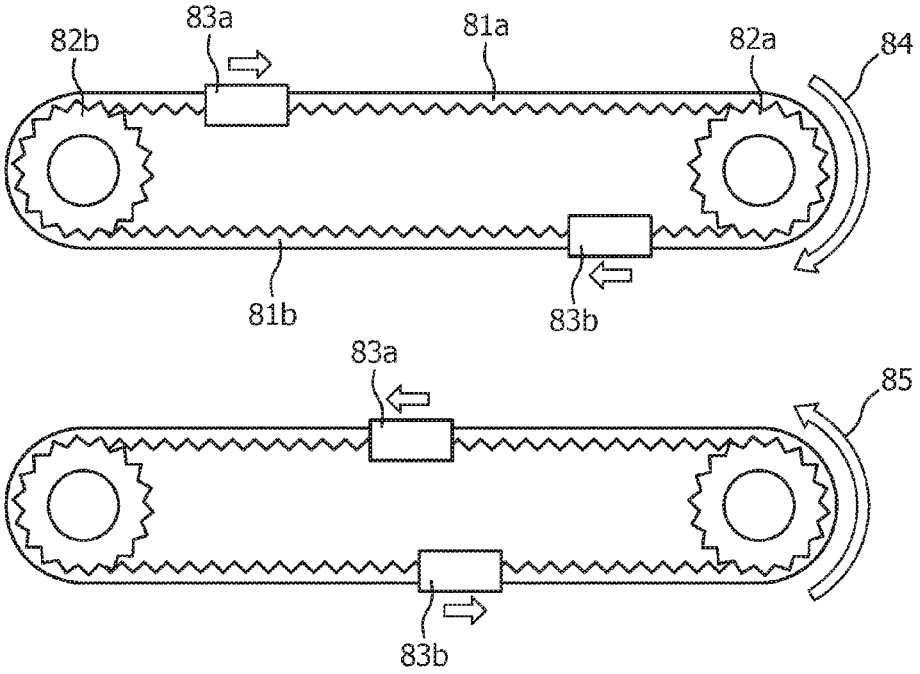
FIG. 8 shows a schematic view of the belt system of a belt driven automated CPR device according to an embodiment of the present invention.

In FIG. 8, a schematic view of a belt system of a belt driven automated CPR device is shown according to an embodiment of the present invention. Referring to the upper figure, a motor and a gear system (not shown) drive one of the pulleys 82*a* in the clockwise direction 84. One arm 45*a* is coupled to a first movable unit 83*a* which is coupled to the belt at an exclusive side 81*a* of the belt system and will thus move to the right. The other arm 45*b* is coupled to a second movable unit 83*b* which is coupled to the belt at another exclusive side 81*b* of the belt system and will thus move to the left. Consequently, the chest pad 46 will move downwards, towards a patient. Referring to the lower figure, reversing the motor direction 85 will cause the arms 45*a,b* and the chest pad 46 to move in opposite directions. Preferably, the belt system is configured such that the pulleys rotate horizontally, i.e. in a plane parallel to the back of the patient. However, the belt system could also be configured such that the pulleys rotate vertically, i.e. in a plane perpendicular to the back of the patient and along the extension of the front structure 43. In that case, one of the arms 45*a,b* is longer than the other arm. The belt is preferably is made of polymer material. The present invention preferably uses a toothed, or timing, belt and pulley. The belt has evenly spaced transverse teeth that fit in matching grooves on the periphery of the pulley.

For the chain system, the principle of operation is similar as the previous embodiment, with the difference that the pulley and the belt are replaced by a chain-wheel and a chain, respectively.

Certain specific details of the disclosed embodiment are set forth for purposes of explanation rather than limitation, so as to provide a clear and thorough understanding of the present invention. However, it should be understood by those skilled in this art, that the present invention might be practiced in other embodiments that do not conform exactly to the details set forth herein, without departing significantly from the spirit and scope of this disclosure. For example, the present invention is not limited to claiming a CPR device with only two arms, two movable units, two pulleys, or two chain-wheels. Further, in this context, and for the purposes of brevity and clarity, detailed descriptions of well-known apparatuses, circuits and methodologies have been omitted so as to avoid unnecessary detail and possible confusion.

The invention claimed is:

1. An automated CPR device for cyclically compressing a patient's chest comprising:

a front structure with a first and a second movable unit arranged to move back and forth along said front structure;

a back support for positioning behind the patient's back arranged to keep the front structure in a fixed position relative to the patient's back;

a chest pad;

two arms each rotatably coupled to the chest pad with one end and each being rotatably coupled to a respective one of the first and the second movable units; and driving means arranged for, when in operation, driving the first and the second movable units back and forth such that the chest pad cyclically compresses the patient's chest.

2. The automated CPR device according to claim 1, wherein said front structure comprises a threaded, driven spindle, and said first and second movable units are arranged to engage with the threaded spindle so as to move back and forth along said front structure.

3. The automated CPR device according to claim 2, wherein said spindle comprises two parts with an opposite lead direction so as to move said first and second movable units in opposite directions.

4. The automated CPR device according to claim 1, wherein said front structure comprises a belt system comprising a belt and a pulley, the belt being arranged to be driven by and looped around the pulley, and said first and second movable units are coupled to said belt so as to move back and forth along said front structure.

5. The automated CPR device according to claim 4, wherein the belt system comprises another pulley for the belt to be looped around, the belt system extending along the front structure, and said first and said second movable units are each arranged to be coupled on a respective, mutually exclusive side of the belt system so as to move in opposite directions in relation to each other.

6. The automated CPR device according to claim 1, wherein said front structure comprises a chain system comprising a chain and a chain-wheel, the chain being arranged to be driven by and looped around the chain-wheel, and said first and second movable units are coupled to said chain so as to move back and forth along said front structure.

7. The automated CPR device according to claim 6, wherein the chain system comprises another chain-wheel for the chain to be looped around, the chain system extending along the front structure, and said first and said second movable units are each arranged to be coupled on a respective, mutually exclusive side of the chain system so as to move in opposite directions in relation to each other.

8. The automated CPR device according to claim 1, wherein said driving means is selected from the group consisting of an electromagnetic, a pneumatic, or a hydraulic motor, which provides a rotational force.

* * * * *